US007570875B1

(12) United States Patent
Groves et al.

(10) Patent No.: US 7,570,875 B1
(45) Date of Patent: Aug. 4, 2009

(54) HANDHELD HEATING TOOL

(75) Inventors: Sydney L. Groves, Rancho Palos Verdes, CA (US); Stephen C. James, San Pedro, CA (US)

(73) Assignee: Judco Manufacturing, Inc., Harbor City, CA (US)

( * ) Notice: Subject to any disclaimer, the term of this patent is extended or adjusted under 35 U.S.C. 154(b) by 370 days.

(21) Appl. No.: 11/437,492

(22) Filed: May 18, 2006

Related U.S. Application Data

(60) Provisional application No. 60/682,097, filed on May 18, 2005.

(51) Int. Cl.
*F26B 3/30* (2006.01)
*F21B 1/00* (2006.01)

(52) U.S. Cl. ..... 392/411; 219/405

(58) Field of Classification Search ..... 392/411, 392/412, 413, 414, 415, 416, 419, 420, 421, 392/423; 219/405, 406, 407, 408, 409, 410, 219/411; 362/227; 250/504
See application file for complete search history.

(56) References Cited

U.S. PATENT DOCUMENTS 3,831,289 A * 8/1974 Knight ..... 34/278
6,002,110 A * 12/1999 Sikka et al. ..... 219/411
6,426,486 B1 7/2002 Bartok

* cited by examiner

*Primary Examiner*—Daniel L Robinson
(74) *Attorney, Agent, or Firm*—Michael Zarrabain, Esq.; Myers Andras Sherman LLP

(57) ABSTRACT

A handheld heating tool has a pair of elliptical reflectors with the major axes of the ellipses being at an acute angle to each other and intersecting in a focal region including one focus of each ellipse. A pair of incandescent bulbs are mounted so that each bulb filament is at the other focus of one of the elliptical reflectors. Thus, radiant energy from both bulbs is concentrated at the focal region. This focal region lies in a channel at the front of the housing of the tool. An object to be heated lying in the channel receives radiant energy from the lamps and reflectors. A blower directs cooling air toward the reflectors and along different paths within the housing to exit through the channel. One such path is between the outside of the reflectors and adjacent reflector shields.

27 Claims, 8 Drawing Sheets

HANDHELD HEATING TOOL

CROSS-REFERENCE TO RELATED APPLICATION

This application claims benefit priority of the filing date of U.S. Patent Application No. 60/682,097, filed May 18, 2005. The subject matter of the above-identified application is hereby incorporated by reference as if set forth in full herein.

FIELD OF THE INVENTION

Handheld heating apparatus for heat shrinkable tubing and the like.

BACKGROUND

Heating apparatus for heat shrinkable tubing or the like is described and illustrated in U.S. Pat. No. 6,246,486 by Bartok. That heating apparatus has a plurality of heating elements such as incandescent bulbs within reflectors which concentrate the heat from such bulbs into a small region. Objects placed in this focal region are thereby heated. A significant use of such apparatus is to heat shrink tubing such as commonly used around electrical wiring bundles and the like. Such apparatus may also be used for soldering, desoldering and other purposes where concentrated high temperature is desired.

This invention comprises a handheld tool for heating tubing or the like as an improvement over what is described in the aforementioned Bartok patent. The handheld tool can be taken to the workpiece to be heated rather than taking the workpiece to heating apparatus.

BRIEF SUMMARY OF THE INVENTION

Thus, in practice of this invention according to a presently preferred embodiment, there is a handheld heating tool having a pair of elliptical reflectors mounted in a housing. The reflectors focus radiant energy from incandescent bulbs in the reflectors toward a focal region lying in a channel across the nose of the tool housing. A blower directs cooling air through various paths within the housing.

DRAWINGS

DETAILED DESCRIPTION

Figure 2:
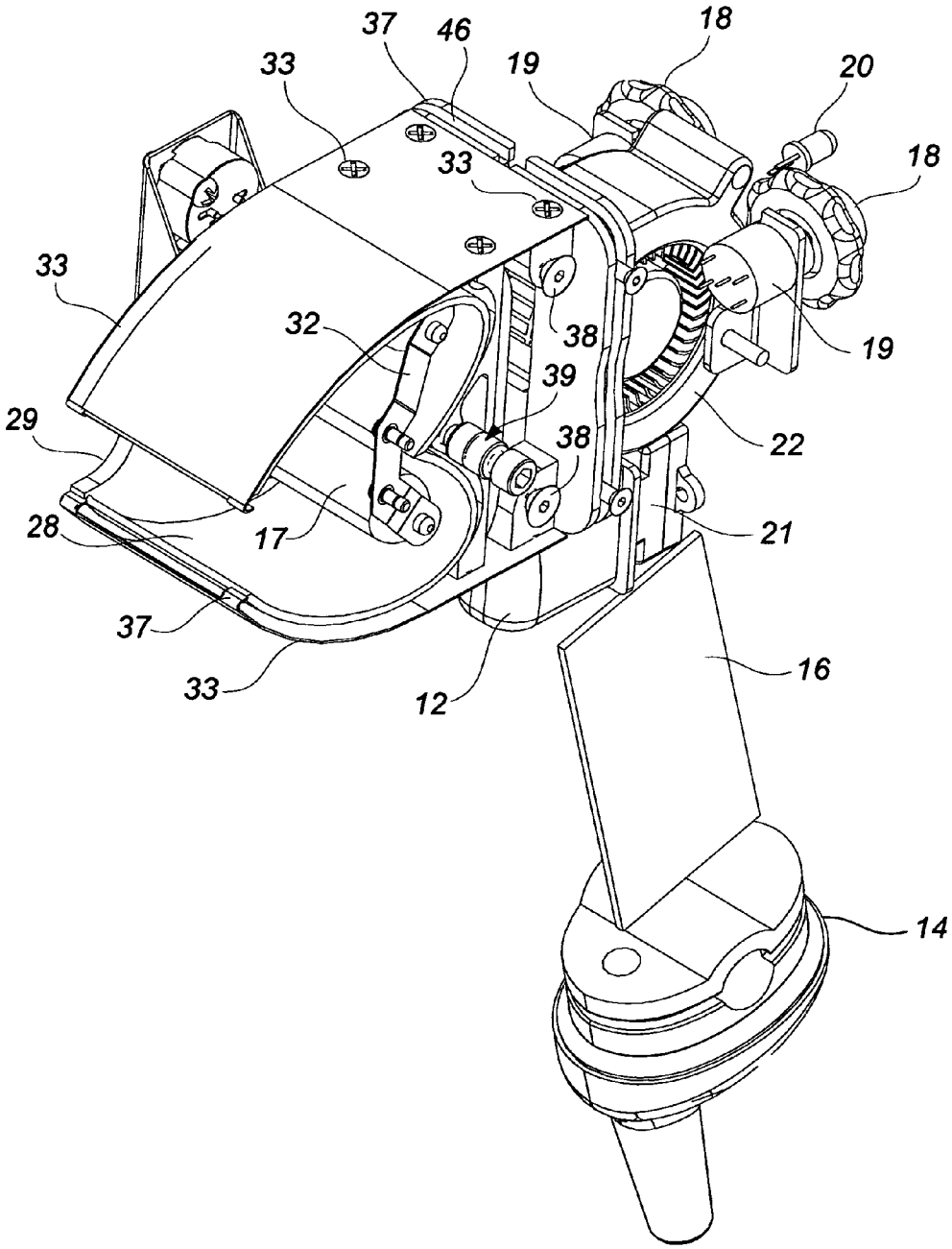
FIG. 2 is a similar view with the two halves of the heating tool housing removed to disclose internal structure.

The handheld tool for heating heat shrinkable tubing or the like has a right housing half 10 and left housing half 11 bolted together to encompass almost the entire working elements of the tool. The two housing halves include a handle and support a trigger 12 (FIG. 2). Thus the tool somewhat resembles a handheld hairdryer or electric drill. There is a transverse channel 13 across the nose of the housing which receives the object to be heated by the heating tool. This permits the handheld heating tool to be placed around the object (for example, heat shrinkable tubing around a connector) in situ, instead of carrying the object to a bench top heater. The housing halves are preferably made of heat resistant injection molded plastic since such materials have lower thermal conductivity than metal, and are therefore more comfortable in the hand of the operator. Most of the rest of the heating tool, the internal structural elements, is metal.

A strain relief fitting 14 at the end of the handle connects to an electric cord (not shown) for providing current to the heating tool. It can be seen in FIG. 2 where the housing halves have been removed, that a substantial part of the strain relief fitting is clamped inside the handle. The internal wiring of the heating tool is omitted since unnecessary for an understanding of this invention. All of the wiring that is left in FIG. 2 is an exemplary printed circuit board 16 inside the handle, for a portion of the control components of the heating tool.

Figure 3:
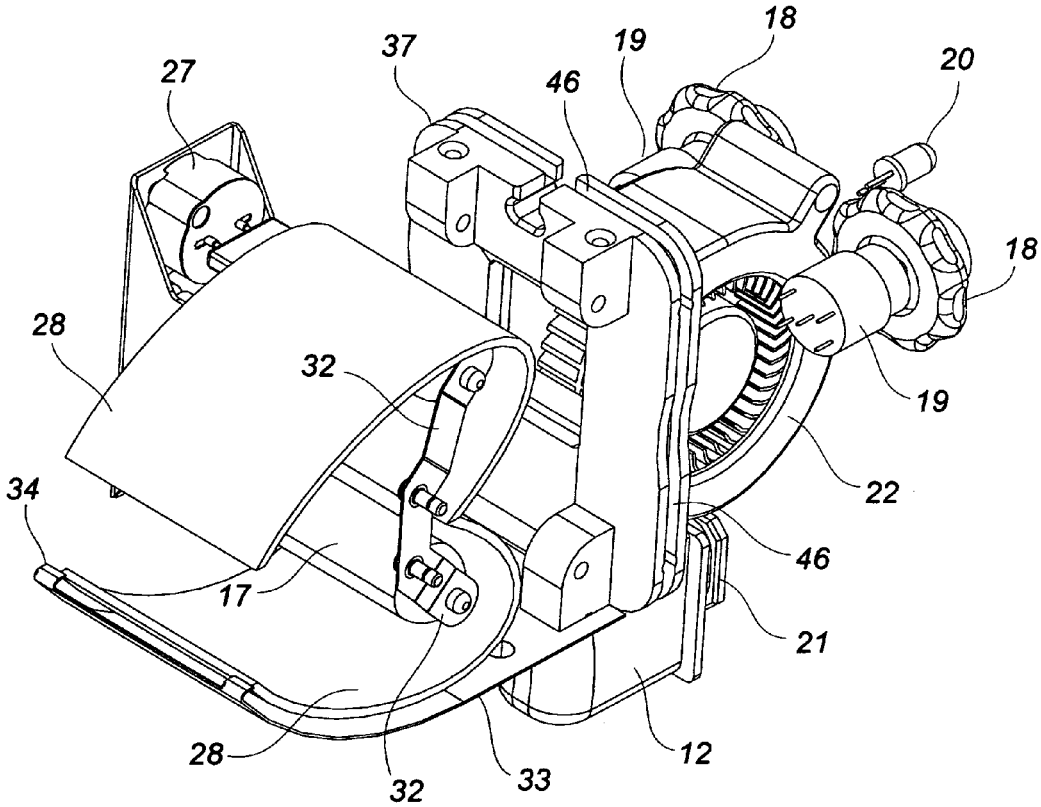
FIG. 3 is a similar fragmentary view with some of the internal structure removed to disclose underlying structure.

Heat in the heating tool is generated by a pair of conventional incandescent bulbs 17 in the form of a sealed cylindrical quartz tube and a longitudinally extending helical filament. There are two thumb wheels 18 at the rear of the housing with only an edge of each wheel exposed outside the housing. Each of the thumb wheels is connected to a controller 19 inside the housing. One of the controllers can be used to control the magnitude of current applied to the incandescent bulbs. The other controller can be manipulated by the corresponding thumb wheel to control the time interval that current is supplied to the incandescent bulbs. Indicia (not shown) on the thumb wheels and housing indicate the settings chosen by the operator. A light emitting diode 20 at the rear of the housing between the thumb wheels indicates when the heating tool is on. The thumb wheels, controllers and LED are omitted from the drawings subsequent to FIG. 3.

Figure 1:
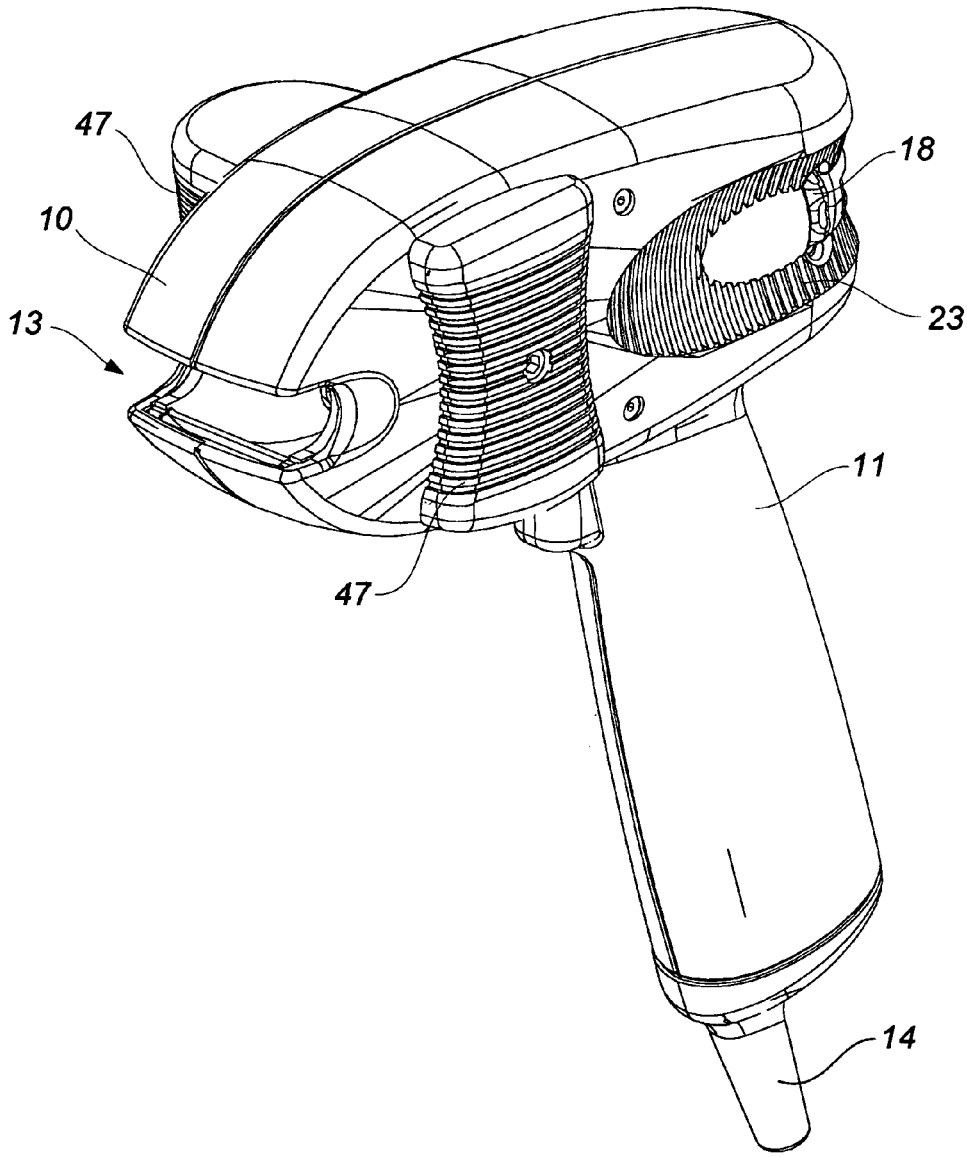
FIG. 1 is an external view of a handheld heating tool constructed according to principles of this invention.

Current is applied to the incandescent bulbs via the PC board and controllers when a switch 21 is closed when the trigger is depressed. There is a centrifugal fan or blower 22 near the rear of the housing which draws air through slots 23 in the housing (FIG. 1). Cooling air is directed from the blower toward the incandescent bulbs and along various paths within the housing to exit through the channel at the nose of the tool. If desired, the blower may be kept ON by keeping the trigger depressed, and the time current is applied to the bulbs is limited by one of the controllers. Thus, the cooling time for the housing may be longer than the heating time for keeping part of the heating tool components cool.

Figure 4:
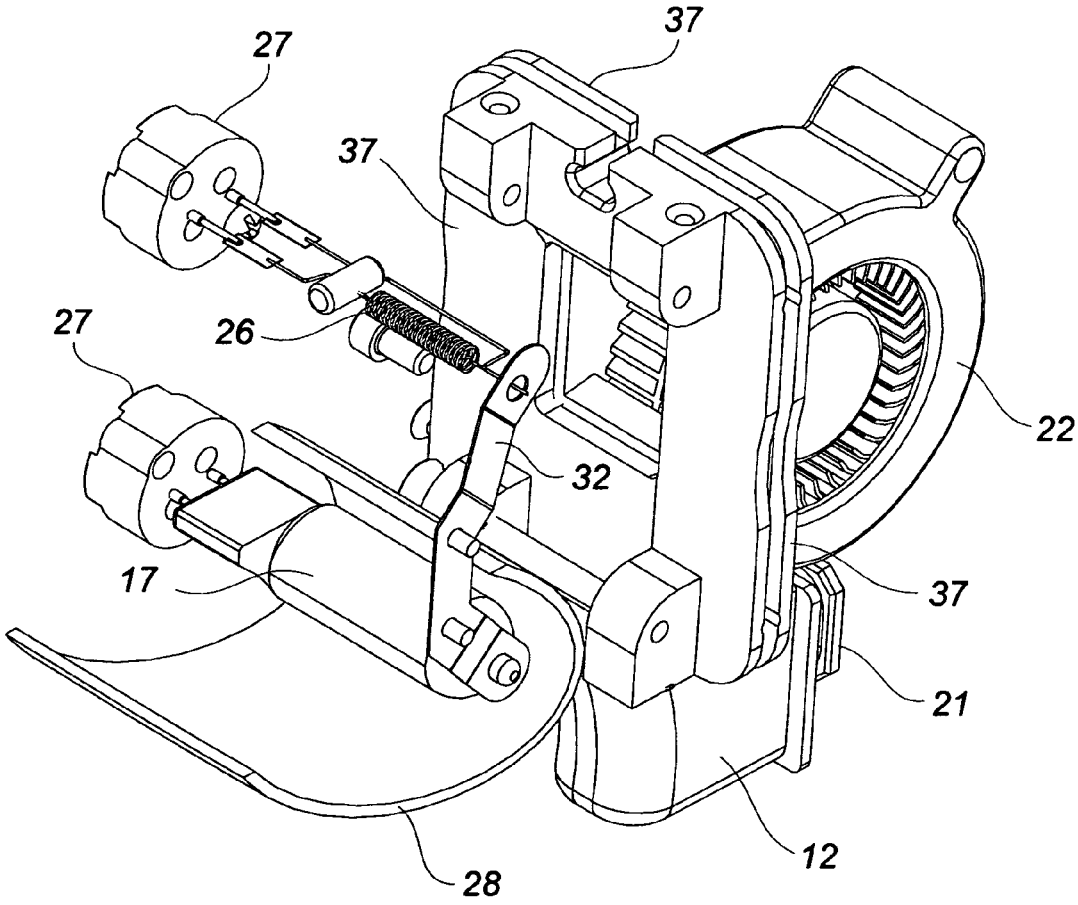
FIG. 4 is a view similar to FIG. 3 with additional structural elements removed to disclose additional underlying structure.

The two incandescent bulbs in the heating tool each comprise a glass envelope with an elongated filament 26 (FIG. 4). Each of the bulbs has its electrical leads plugged into a socket 27. The incandescent bulbs are located within elliptical reflectors 28. Each elliptical reflector is bent to the desired shape from a flat sheet of pre-polished aluminum to form a portion of an elliptical surface. By using pre-polished metal sheets for the reflectors, difficult polishing of convex surfaces can be avoided. As illustrated, the elliptical reflectors are bent to shape essentially in a single direction normal to the filament in the bulb. That is, a line from one side edge of the reflector to the opposite side edge parallel to the filament is a straight line. If desired, the reflectors may be shaped with some additional concavity from side to side to concentrate radiant energy toward the centerline of the tool. Although called elliptical reflectors herein, it is apparent from the drawings that the reflectors are less than an entire ellipse; something more than half of an ellipse in this embodiment.

Each incandescent bulb is located so that its filament lies along the one focus of the respective elliptical surface. The major axes of the two ellipses are at an acute angle from each other so that the major axes intersect at the other focus of the respective ellipses. Radiation from the filament at one focus is concentrated at the other focus of the ellipse. Thus, radiation from the two bulbs is concentrated at a focul region where the major axes of the ellipses intersect. This focal region lies within the channel near the nose of the heating tool. Thus, when an object to be heated, such as for example, heat shrinkable tubing, is located in the channel, it receives radiation from both bulbs directly and as reflected by the two elliptical surfaces. Since most of the radiant energy is directed toward one face of such an object in the channel, the handheld heating tool may be rotated around the object for more uniform heating, if desired. Furthermore, the handheld heating tool may easily be moved along the length of an elongated object (such as heat shrinkable tubing around a wire bundle) for progressively heating the object along its length.

Figure 8:
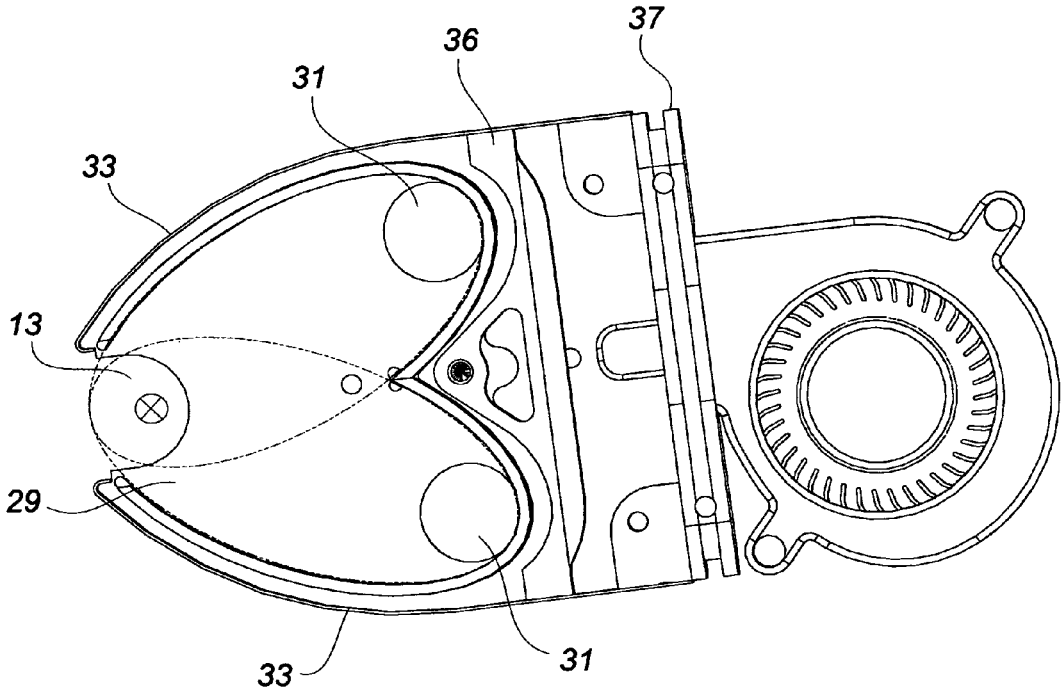
FIG. 8 is a fragmentary cross section similar to FIG. 7 with incandescent bulbs removed and one side panel restored.

The elliptical reflectors are supported in elliptical grooves or against elliptical shoulders (not shown) in a pair of side panels at the side edges of the reflectors. The side panels inhibit warping of the reflectors to hold the elliptical cross section. The right side panel 29 is illustrated along the edge of the reflectors in FIG. 2. The left side panel is omitted from the drawing so that the internal structure of the heating tool can be better illustrated. The right side panel has two openings 31 (FIG. 8) aligned with the bulbs, and the electrical-lead ends of the bulbs pass through the openings to the respective sockets. The left side panel is essentially an identical mirror image of the right side panel except that it does not have openings (like 31) for the electrical-lead ends of the bulbs. Instead, the left side panel supports a bulb clip 32 which holds the ends of the bulbs (opposite from the socket ends) in their correct position.

It may be noted that in various views in the drawings, conventional fasteners, such as those between the omitted left side panel and the bulb clip, have also been omitted from the drawings. Thus, for example, bolts 33 holding the reflector shield in place are illustrated in FIG. 2, but omitted in subsequent figures for purposes of clarity.

Figure 5:
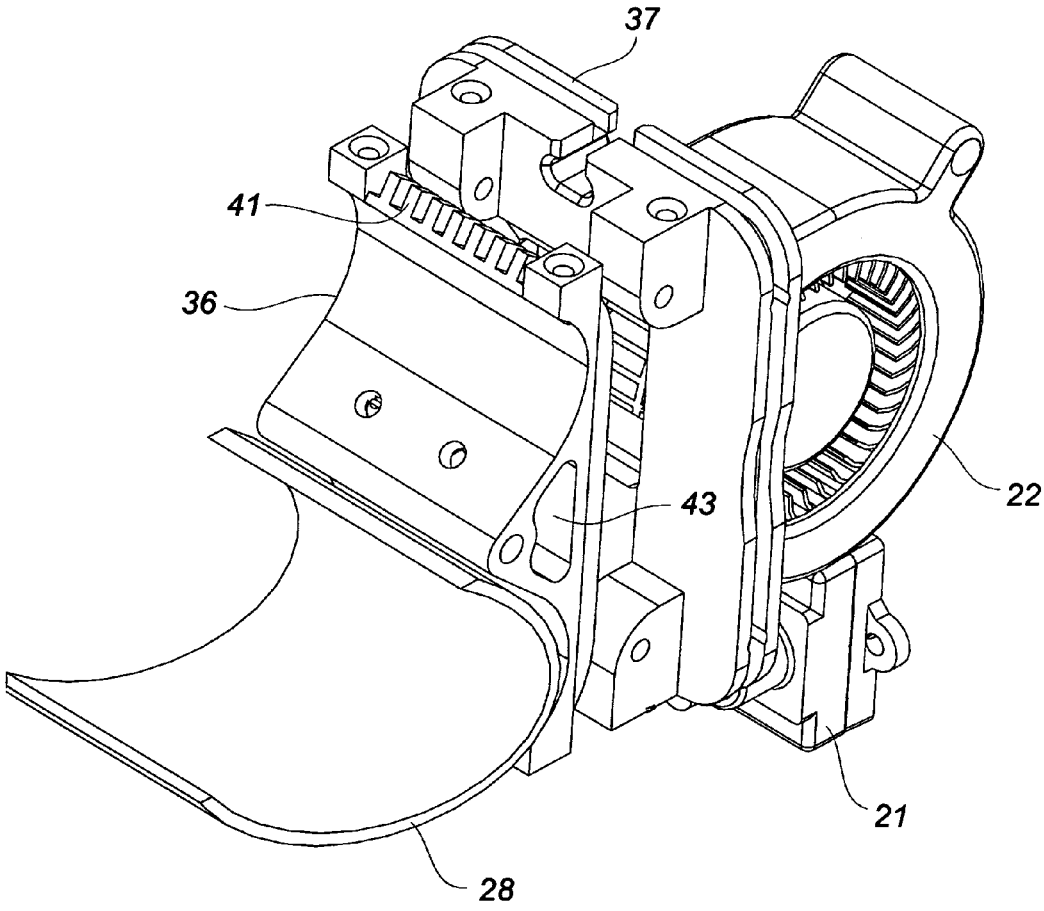
FIG. 5 is a view similar to FIG. 4 with some additional structure removed and an end frame support added back.
Figure 6:
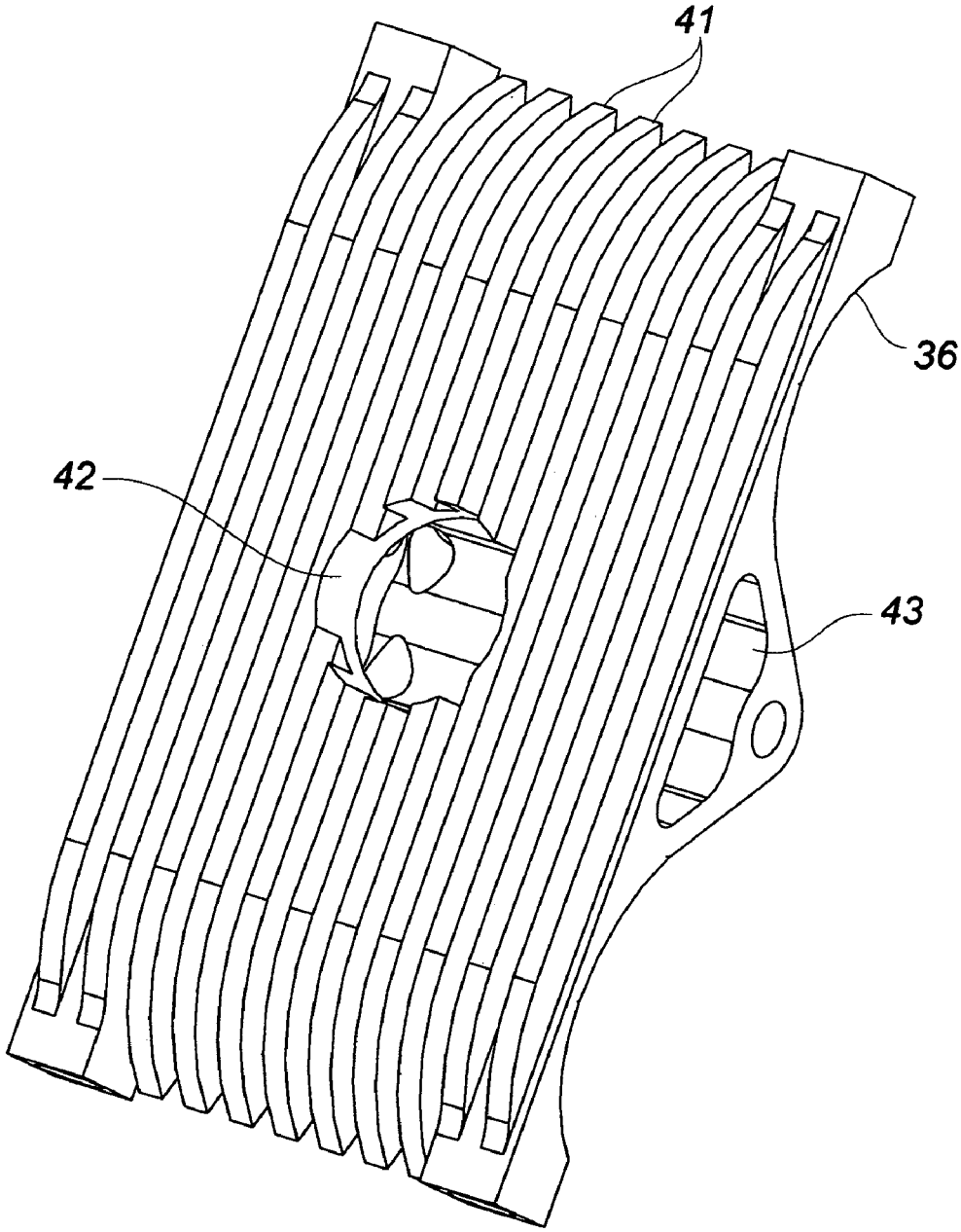
FIG. 6 is an isometric view of the face of the end frame support opposite the face illustrated in FIG. 5.
Figure 7:
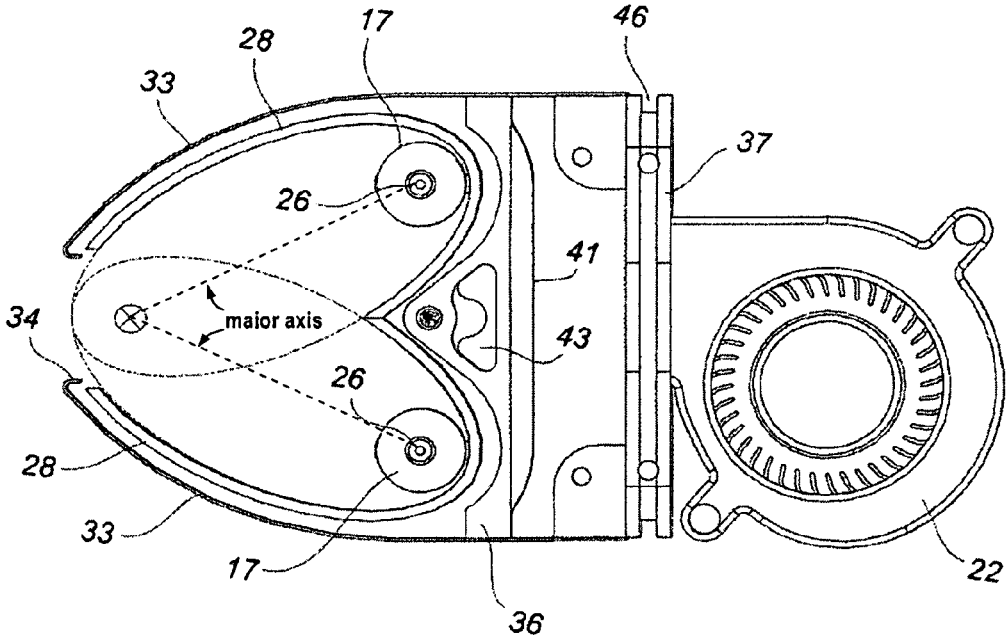
FIG. 7 is a fragmentary cross section through a part of the handheld heating tool illustrating the reflectors.

A reflector shield 33 lies along the outside contour of each edge of the side panels (i.e., two reflector shields, one above and one below the respective reflectors). A forward part of each reflector shield is curved to lie parallel to an outside face of the respective reflector. The reflector shields are spaced apart from the reflectors to leave an air passage therebetween. A small curled tip 34 clips around an edge of a side panel adjacent to the channel through the nose of the heating tool. The other end of each reflector shield is fastened (by bolts 33, for example) to an end frame support 36 and a rear support 37. The end frame support is best seen in FIGS. 5 and 6. The left and right side panels are fastened to the rear support by bolts 38, for example (FIG. 2). The side panels are also connected to the end frame support by a subassembly of bolts and spacers 39.

Cooling air from the blower passes through a centrally-located rectangular opening through the rear support 37. The air then encounters the back face of the end frame support which is best seen in FIG. 6. The back face has a pattern of parallel ribs which extend in the up and down direction (i.e., more or less parallel to the handle) when the heating tool is assembled. The forward face of the end frame support has a shape generally similar to the outside surface of the reflectors. The end frame support acts as a heat sink between the front and back of the tool. Waste heat passing through the reflectors is conveyed by the end frame support to the cooling air from the fan by way of the fins on the back face. Air leaving the back face of the end frame support is then guided through the passages between the reflectors and reflector shields and is discharged at the edges of the channel at the nose of the heating tool.

The back of the end frame support also has a central hole 42 in the path of air from the blower passing through the rear support. Such cooling air then is guided through a lateral passage 43 where some of the air enters the space between the right side panel 29 and the inside of the housing. Some of that air then passes through the openings 31 through the right side panel into the space inside the reflectors. This keeps the connector ends of the bulbs and their respective sockets from overheating.

Cooling air is discharged from the heating tool at the channel across the nose of the tool. Ribs (not shown) within the two housing halves fit in a peripheral slot or groove 43 around the rear support for minimizing air flow from the forward part of the tool into the cavity where the blower inlet is located. This helps keep the rear of the tool, control devices, and the handle cool. Heat is also dissipated from a forward part of the tool by ribs 47 on both housing halves.

Although warm air is discharged from the front of the handheld heating tool, it is better than heating tools which are like high temperature hair dryers. Most of the energy for heating the object in the channel is conveyed as radiant energy instead of hot air, so there is less air discharge and the discharged air is at a lower temperature so that structures near the object to be heated are not adversely affected by a blast of hot air.

What is claimed is:

1. A handheld heating tool comprising:

a housing having a handle;

a pair of polished elliptical reflectors mounted in the housing, the major axes of the two ellipses intersecting in a focal region within the housing, the focal region including one focus of each ellipse;

a pair of incandescent bulbs, each bulb being mounted with a filament at the other focus of one of the elliptical reflectors;

a trigger switch adjacent the handle for sending electric current to the bulbs, and a controller for controlling the magnitude of current applied to the bulbs;

a transverse channel in a nose of the housing for receiving an article to be heated in the focal region, wherein the channel is transverse to the major axes of the pair of elliptical reflectors; and a blower directing cooling air toward the reflectors and exiting the housing through the channel.

2. A handheld heating tool according to claim 1 wherein the elliptical reflectors are formed of a bent sheet of pre-polished metal, and the handheld heating tool further comprising means for setting a time interval for application of current from the switch to the bulbs.

3. A handheld heating tool according to claim 1 further comprising an elliptical reflector shield along the outside of each reflector defining a passage therebetween for cooling air.

4. A handheld heating tool according to claim 1 further comprising a side panel at each end of the reflectors holding the reflectors in an elliptical shape.

5. A handheld heating tool according to claim 4 further comprising holes through one of the side panels for passage of cooling air from outside the side panel into the region inside the reflectors.

6. A handheld heating tool according to claim 1 further comprising a heat sink adjacent to at least a portion of the reflectors and in the path of cooling air from the blower.

7. A handheld heating tool comprising:

a housing;

a pair of elliptical reflectors in the housing, the major axes of the two ellipses intersecting in a focal region within the housing, the focal region including one focus of each ellipse;

a pair of incandescent bulbs, each bulb being mounted with a filament at the other focus of one of the elliptical reflectors;

a blower directing cooling air toward the reflectors;

a reflector shield along an outside face of each reflector directing cooling air along the outside face; and a controller for controlling the magnitude of current applied to the incandescent bulbs.

8. A handheld heating tool according to claim 7 further comprising a heat sink adjacent to at least a portion of the reflectors and in the path of cooling air from the blower, and means for setting a time interval for application of current from the switch to the bulbs.

9. A handheld heating tool according to claim 7 wherein the elliptical reflectors are formed of a bent sheet of pre-polished metal.

10. A handheld heating tool according to claim 7 wherein the housing comprises a handle and a trigger switch for sending current to the bulbs, and a transverse channel in a forward end of the housing for receiving an object to be heated by radiant energy from the bulbs, wherein the channel is transverse to the major axes of the pair of elliptical reflectors.

11. A handheld heating tool comprising:

a housing;

a pair of elliptical reflectors in the housing, the major axes of the two ellipses intersecting in a focal region within the housing, the focal region including one focus of each ellipse;

a pair of incandescent bulbs, each bulb being mounted with a filament at the other focus of one of the elliptical reflectors;

a blower directing cooling air toward the reflectors;

a heat sink outside of the reflectors in a region near the bulbs and in the path of cooling air from the blower; and a controller for controlling the magnitude of current applied to the bulbs.

12. A handheld heating tool according to claim 11 further comprising an elliptical reflector shield along the outside of each reflector defining a passage therebetween for cooling air, and means for setting a time interval for application of current from the switch to the bulbs.

13. A handheld heating tool according to claim 11 further comprising a side panel at each end of the reflectors and holes through at least one of the side panels for passage of cooling air from outside the side panel into the region inside the reflectors.

14. A handheld heating tool according to claim 11 wherein the major axes of the ellipses intersect at an acute angle in the focal region, and further comprising a transverse channel in the housing including the focal region, wherein the channel is transverse to the major axes of the pair of elliptical reflectors.

15. A handheld heating tool according to claim 14 further comprising an elliptical reflector shield along the outside of each reflector defining a passage therebetween which opens adjacent the transverse channel for cooling air.

16. A handheld heating tool comprising:

a housing;

a pair of elliptical reflectors in the housing, the major axes of the two ellipses intersecting in a focal region within the housing, the focal region including one focus of each ellipse;

a pair of incandescent bulbs, each bulb being mounted with a filament at the other focus of one of the elliptical reflectors;

a blower directing cooling air toward the reflectors;

a side panel at each end of the reflectors guiding cooling air along the outside face of at least one of such side panels;

means for setting a time interval for application of current from the switch to the bulbs, and means for setting a magnitude of current from the switch to the bulbs.

17. A handheld heating tool according to claim 16 further comprising an opening through one of the side panels for admitting air from outside the side panel into the region bounded by the reflectors.

18. A handheld heating tool according to claim 17 further comprising a heat sink adjacent to at least a portion of the reflectors and in the path of cooling air from the blower.

19. A handheld heating tool according to claim 16 further comprising a heat sink adjacent to at least a portion of the reflectors and in the path of cooling air from the blower.

20. A handheld heating tool comprising:

a housing having a handle;

a pair of elliptical reflectors mounted in the housing, each reflector comprising a pre-polished sheet of metal bent to form a portion of an ellipse, the major axes of the two ellipses being at an acute angle to each other and intersecting in a focal region within the housing, the focal region including one focus of each ellipse;

a pair of incandescent bulbs, each bulb being mounted with a filament at the other focus of one of the elliptical reflectors;

a trigger switch for sending electric current to the bulbs; and means for setting a time interval for application of current from the switch to the bulbs, and means for setting a magnitude of current from the switch to the bulbs.

21. A handheld heating tool according to claim 20 further comprising a blower in a rear portion of the housing directing cooling air toward the reflectors.

22. A handheld heating tool according to claim 20 further comprising a transverse channel in a nose of the housing for receiving an article to be heated in the focal region, wherein the channel is transverse to the major axes of the pair of elliptical reflectors.

23. A handheld heating tool according to claim 22 further comprising air passages along an outside of the reflectors opening at the transverse channel.

24. A handheld heating tool comprising:

a housing having a handle;

a trigger adjacent the handle and an on-off switch connected to the trigger;

a pair of elliptical reflectors mounted in the housing, each reflector comprising a pre-polished sheet of metal bent to form a portion of an ellipse, the major axes of the two ellipses being at an acute angle to each other and intersecting in a focal region within the housing, the focal region including one focus of each ellipse;

a pair of incandescent bulbs, each bulb being mounted with a filament at the other focus of one of the elliptical reflectors;

a transverse channel in a nose of the housing for receiving an article to be heated in the focal region, wherein the channel is transverse to the major axes of the pair of elliptical reflectors;

means for setting a time interval for application of current from the switch to the bulbs;

means for setting a magnitude of current from the switch to the bulbs; and a blower for directing cooling air inside the housing and exiting the housing through the transverse channel.

25. A handheld heating tool according to claim 24 further comprising an elliptical reflector shield along the outside of each reflector defining a passage therebetween for cooling air and opening adjacent to the transverse channel.

26. A handheld heating tool according to claim 25 further comprising a side panel at each end of the reflectors holding the reflectors in an elliptical shape and holes through at least one of the side panels for passage of cooling air from outside the side panel into the region inside the reflectors.

27. A handheld heating tool according to claim 26 further comprising a heat sink adjacent to at least a portion of the reflectors and in the path of cooling air from the blower.

* * * * *